US011005196B1

(12) United States Patent
Zhang et al.

(10) Patent No.: US 11,005,196 B1
(45) Date of Patent: May 11, 2021

(54) ELECTRICAL CONNECTOR

(71) Applicant: STARCONN ELECTRONIC (Su Zhou) Co., LTD, Kunshan (CN)

(72) Inventors: Jian Zhang, Kunshan (CN); Fu Su, Kunshan (CN); Chung-Nan Pao, New Taipei (TW)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 16/882,546

(22) Filed: May 25, 2020

(30) Foreign Application Priority Data

Oct. 23, 2019 (CN) ..... 201911012811.2

(51) Int. Cl.
*H01R 9/24* (2006.01)

(52) U.S. Cl.
CPC ..... *H01R 9/2483* (2013.01)

(58) Field of Classification Search
CPC ..... H01R 9/2483
See application file for complete search history.

(56) References Cited

U.S. PATENT DOCUMENTS 7,377,799 B2 * 5/2008 Kuo ..... H01R 13/6215 439/339
2013/0286563 A1 * 10/2013 Kaneko ..... B60T 8/368 361/679.01
2016/0268716 A1 * 9/2016 Conger ..... H01R 12/716

* cited by examiner

*Primary Examiner* — Jean F Duverne
(74) *Attorney, Agent, or Firm* — Li & Cai Intellectual Property Office

(57) ABSTRACT

An electrical connector includes an insulating body, a plurality of ground terminals, and a plurality of signal terminals, the latter two of which are fastened to the insulating body. The insulating body includes a base board having a first tread and a plurality of protruding portions extending from the base board. Each of the protruding portions has a second tread and a riser connected to the second tread and the first tread. A portion of at least one of the ground terminals embedded in the base board includes a ground shoulder arranged adjacent to the first tread. A portion of at least one of the signal terminals embedded in the base board and one of the protruding portions includes a signal shoulder arranged adjacent to the second tread of the corresponding protruding portion. Top edges of the ground shoulder and the signal shoulder have a gap there-between.

18 Claims, 12 Drawing Sheets

ELECTRICAL CONNECTOR

CROSS-REFERENCE TO RELATED PATENT APPLICATION

This application claims the benefit of priority to China Patent Application No. 201911012811.2, filed on Oct. 23, 2019 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to an electrical connector for transmitting signal in high speed.

BACKGROUND OF THE DISCLOSURE

Conventional connectors are required to transmit signals at higher and higher speeds, so that terminals of the conventional connectors need to satisfy stricter design requirements. For example, the conventional connector includes an insulating body and a plurality of terminals inserted into the insulating body, but a portion of each of the terminals arranged adjacent to the insulating body has a high characteristic impedance that is disadvantageous to high-speed transmission of signals.

SUMMARY OF THE DISCLOSURE

In response to the above-referenced technical inadequacies, the present disclosure provides an electrical connector to effectively improve the issues associated with conventional connectors.

In one aspect, the present disclosure provides an electrical connector, which includes an insulating body, a plurality of ground terminals, and a plurality of signal terminals. The insulating body includes a base board and a plurality of protruding portions extending from the base board. The base board has a first tread, and each of the protruding portions has a second tread and a riser that is connected to the second tread and the first tread. The ground terminals are fastened to the base board. At least one of the ground terminals includes an embedded ground segment, a fixing ground segment, and a contacting ground segment. Specifically, the embedded ground segment is disposed in the base board and has a ground shoulder arranged adjacent to the first tread. The fixing ground segment extends from an end of the embedded ground segment along an insertion direction to protrude from the insulating body. The contacting ground segment extends from another end of the embedded ground segment along the insertion direction to protrude from the insulating body. The signal terminals are fastened to the base board and are respectively inserted into the protruding portions. At least one of the signal terminals includes an embedded signal segment, a fixing signal segment, and a contacting signal segment. Specifically, the embedded signal segment is disposed in the base board and the corresponding protruding portion and has a signal shoulder arranged adjacent to the second tread of the corresponding protruding portion. The fixing signal segment extends from an end of the embedded signal segment along the insertion direction to protrude from the insulating body. The contacting signal segment extends from another end of the embedded signal segment along the insertion direction to protrude from the insulating body. In the at least one of the ground terminals having the ground shoulder and the at least one of the signal terminals having the signal shoulder, a top edge of the ground shoulder arranged adjacent to the first tread and a top edge of the signal shoulder arranged adjacent to the corresponding second tread have a gap there-between along the insertion direction.

Therefore, the ground terminal and the signal terminal of the electrical connector in the present disclosure can be formed with the ground shoulder and the signal shoulder, and the ground shoulder and the signal shoulder are respectively arranged at different planes by having the gap therebetween, so that the width of the ground shoulder and the width of the signal shoulder can be wider for effectively reducing the impedance and increasing the distribution density of terminals of the electrical connector, thus achieving the miniaturization of the electrical connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
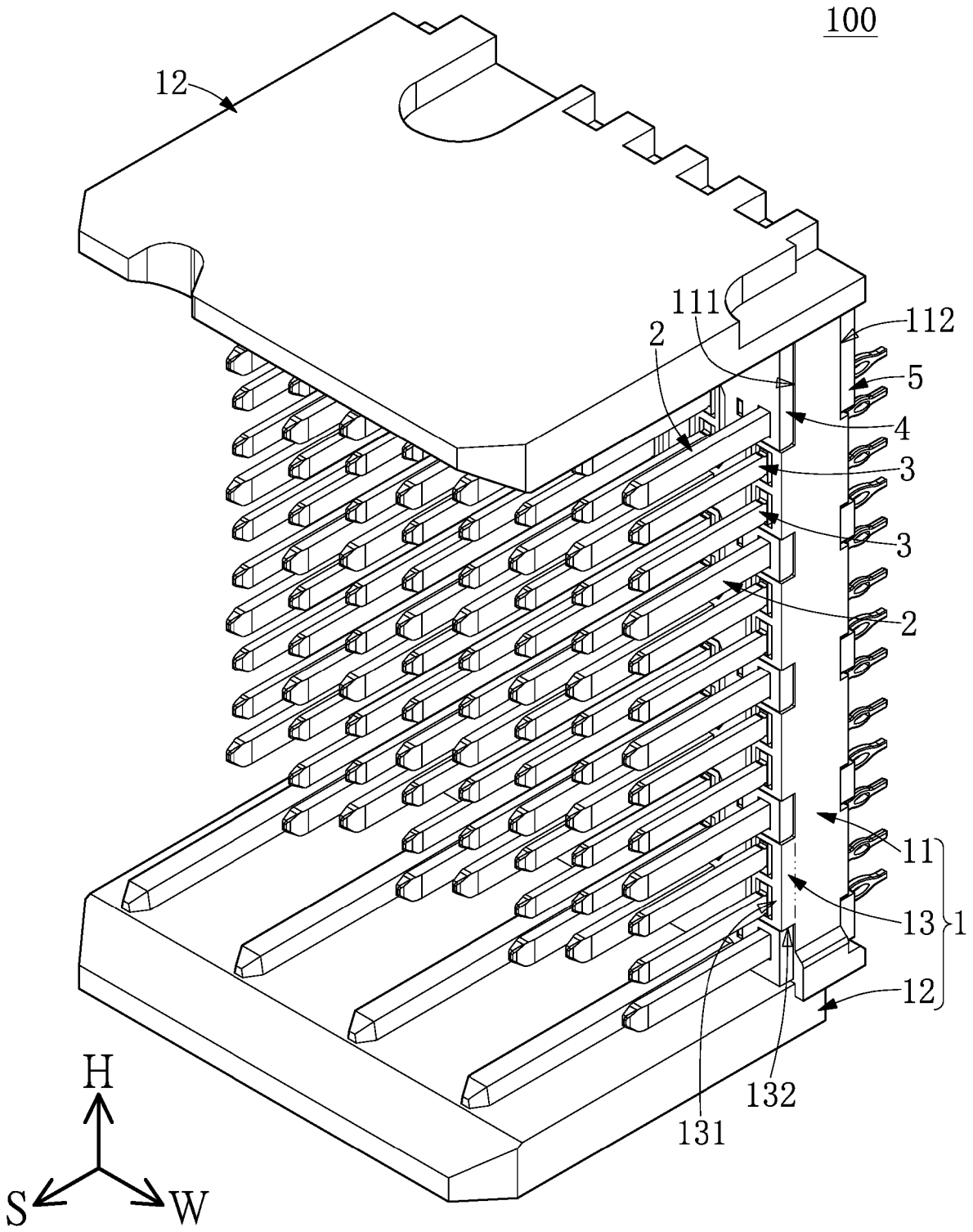
FIG. 1 is a perspective view of an electrical connector according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
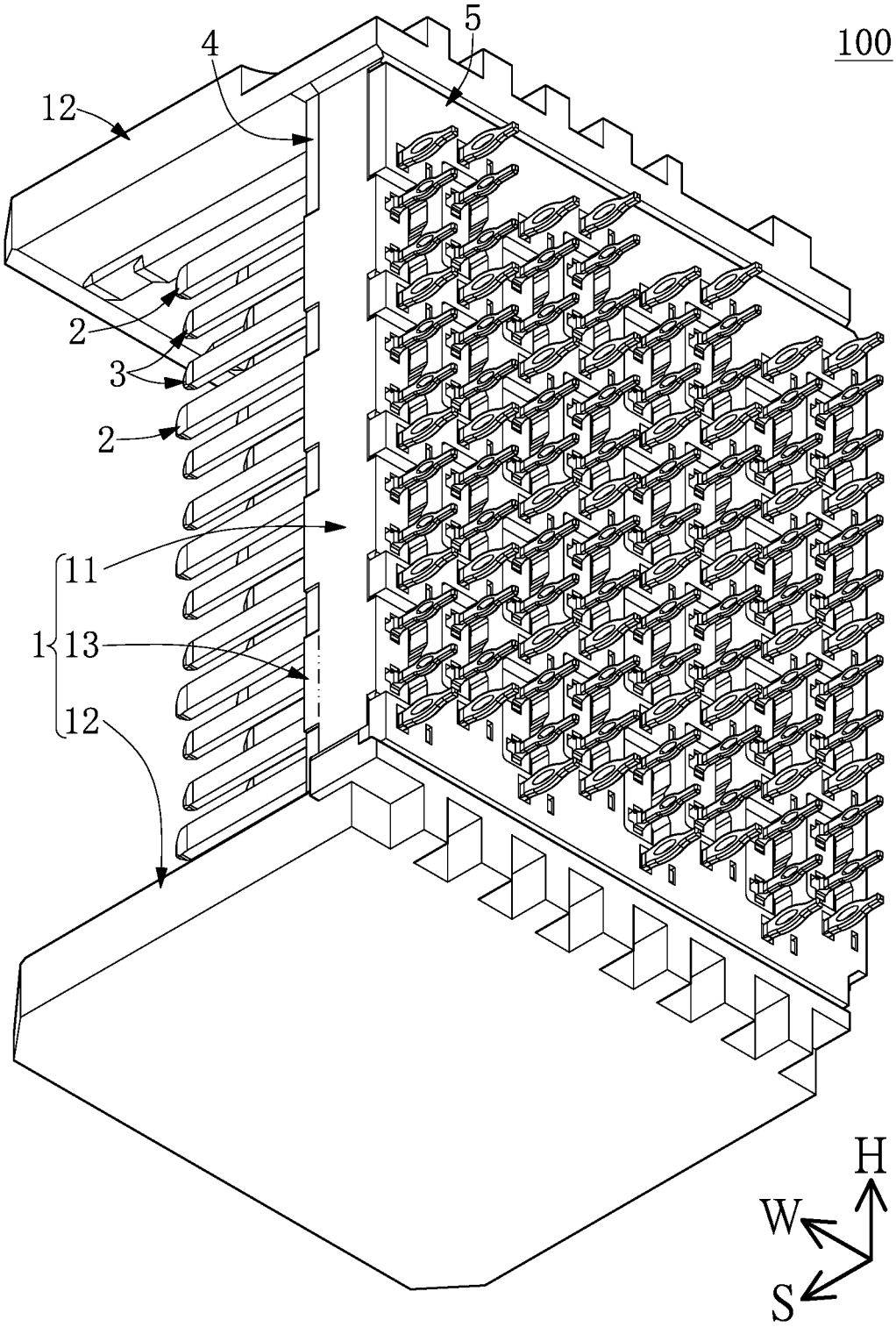
FIG. 2 is a perspective view showing the electrical connector from another angle of view.
Figure 3:
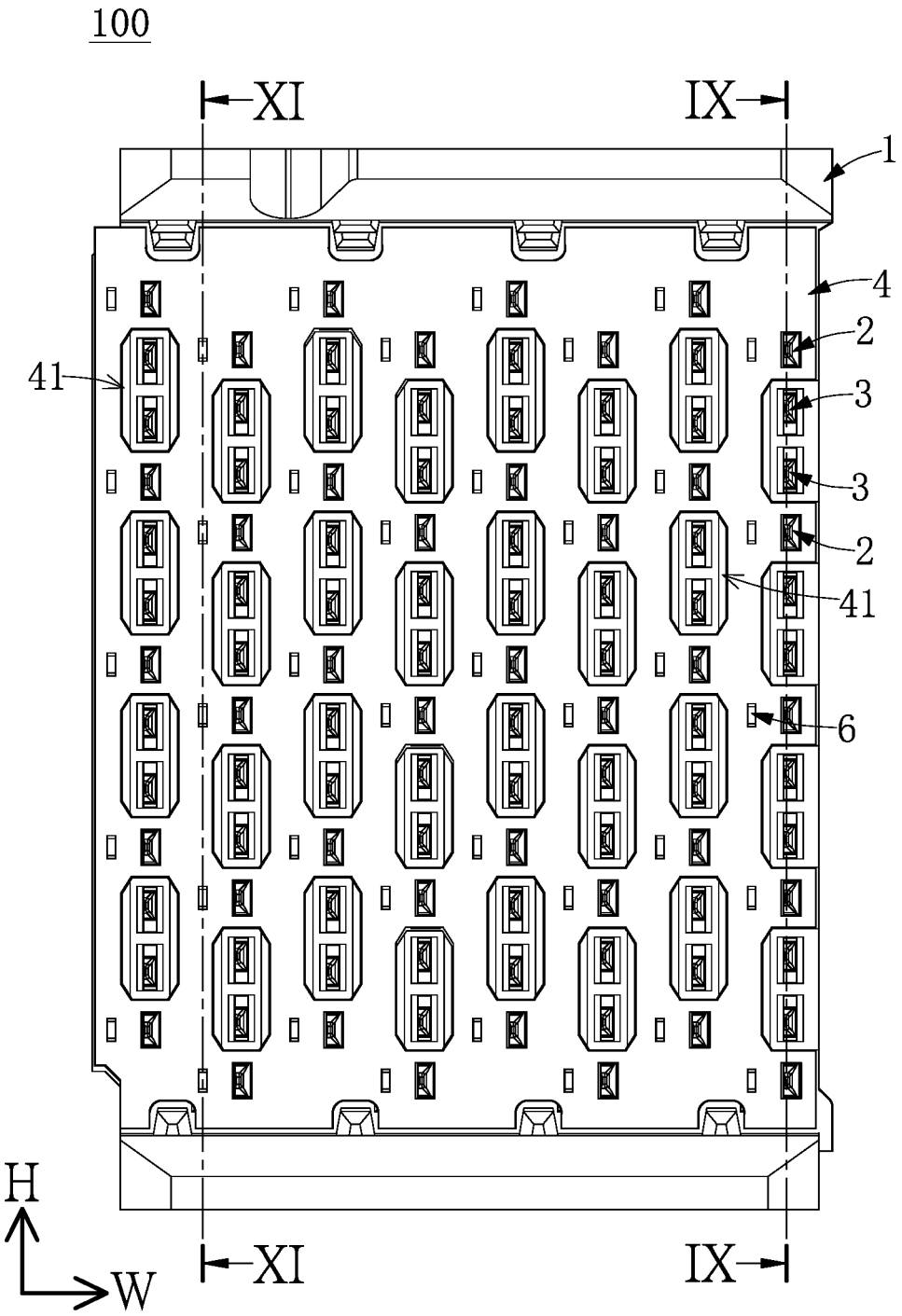
FIG. 3 is a front view of FIG. 1.

Referring to FIG. 1 to FIG. 10, an embodiment of the present disclosure provides an electrical connector 100. As shown in FIG. 1 to FIG. 3, the electrical connector 100 is configured to be detachably inserted into a mating connector (not shown) along an insertion direction S, and the electrical connector 100 can be a high speed (or high frequency) connector applied to a server or a switchboard, but the present disclosure is not limited thereto. For ease of describing the present embodiment, the electrical connector 100 further defines a width direction W and a height direction H both perpendicular to each other and perpendicular to the insertion direction S.

Figure 4:
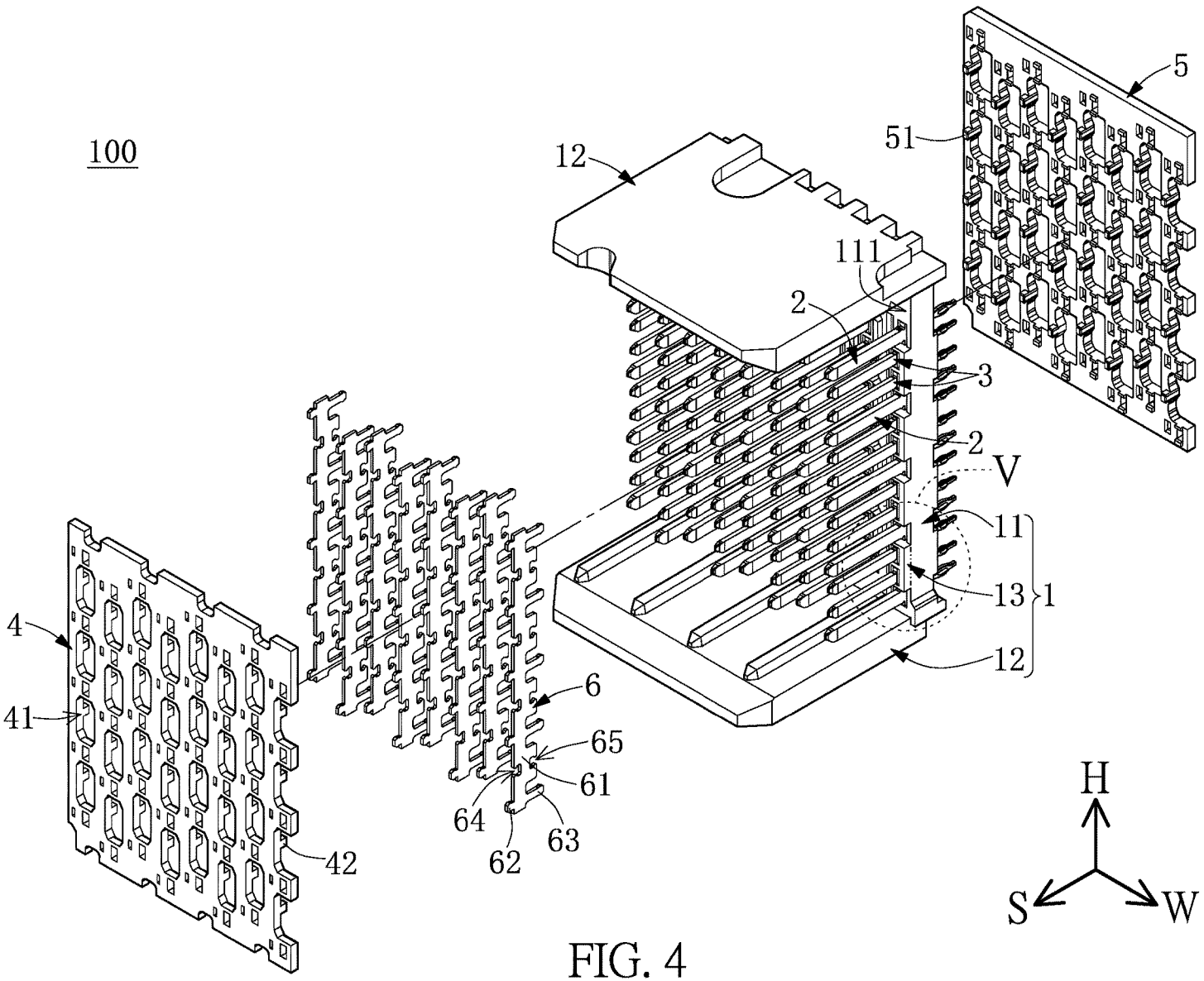
FIG. 4 is an exploded view of FIG. 1.
Figure 5:
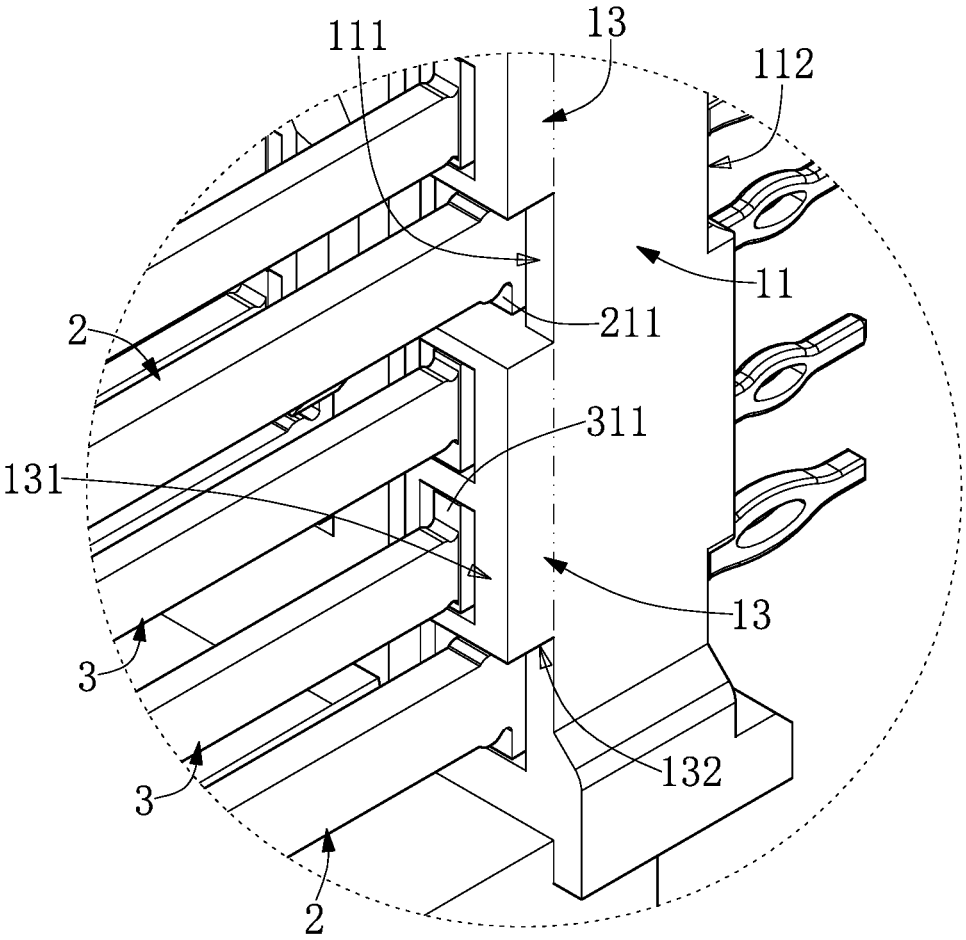
FIG. 5 is an enlarged view of portion V of FIG. 4.
Figure 6:
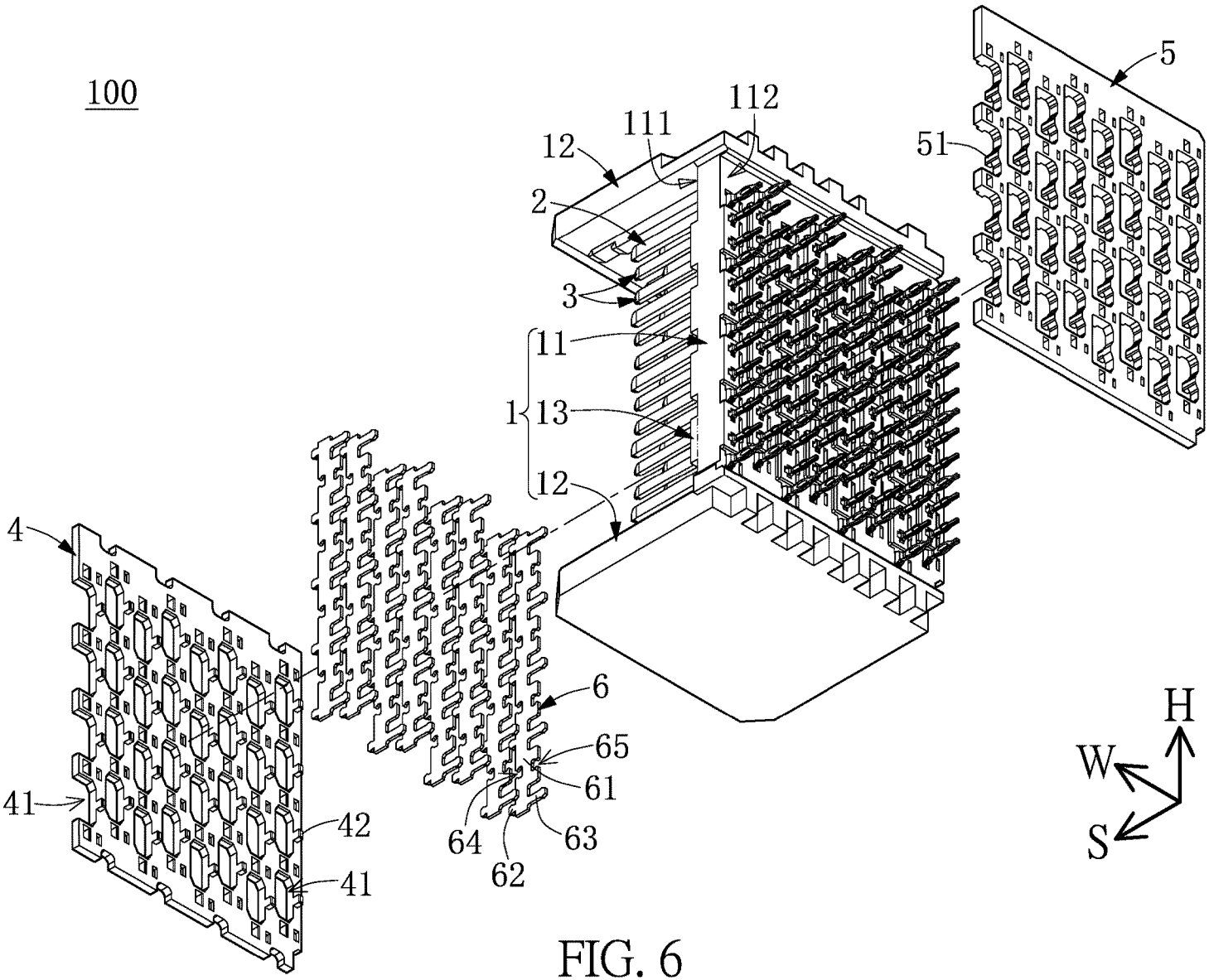
FIG. 6 is an exploded view of FIG. 2.

As shown in FIG. 4 to FIG. 6, the electrical connector 100 includes an insulating body 1, a plurality of ground terminals 2 and a plurality of signal terminals 3 which are fastened to the insulating body 1, a first conductive member 4 and a second conductive member 5 respectively disposed on two opposite sides of the insulating body 1, and a plurality of grounding members 6 that is connected to the first conductive member 4 and the second conductive member 5. The electrical connector 100 of the present embodiment is provided with the above components, but the present disclosure is not limited thereto. For example, in other embodiments of the present disclosure, the electrical connector 100 can be provided without at least one of the first conductive member 4, the second conductive member 5, and the grounding members 6.

Figure 7:
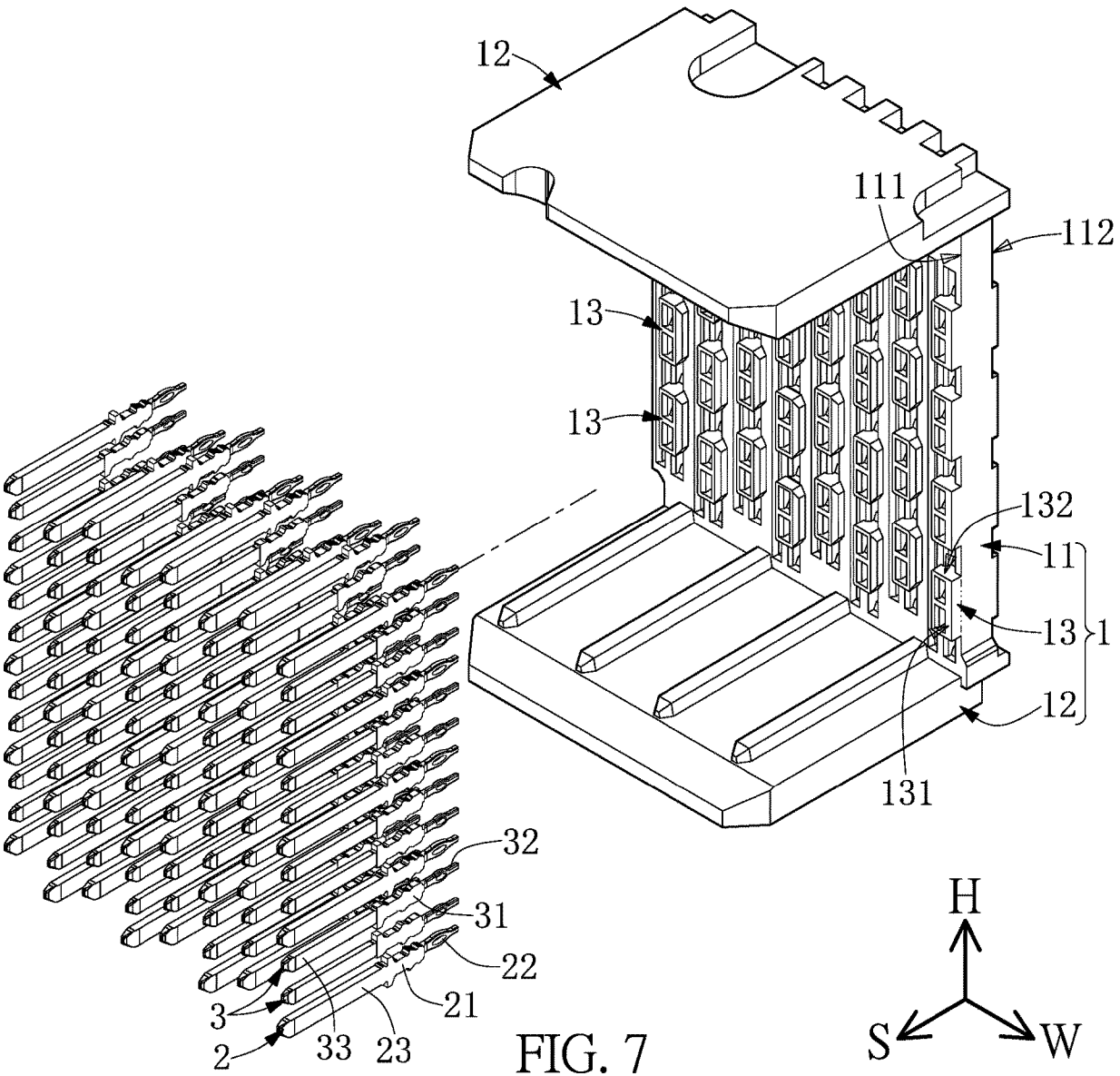
FIG. 7 is an exploded view showing an insulating body, ground terminals, and signal terminals of FIG. 1.
Figure 8:
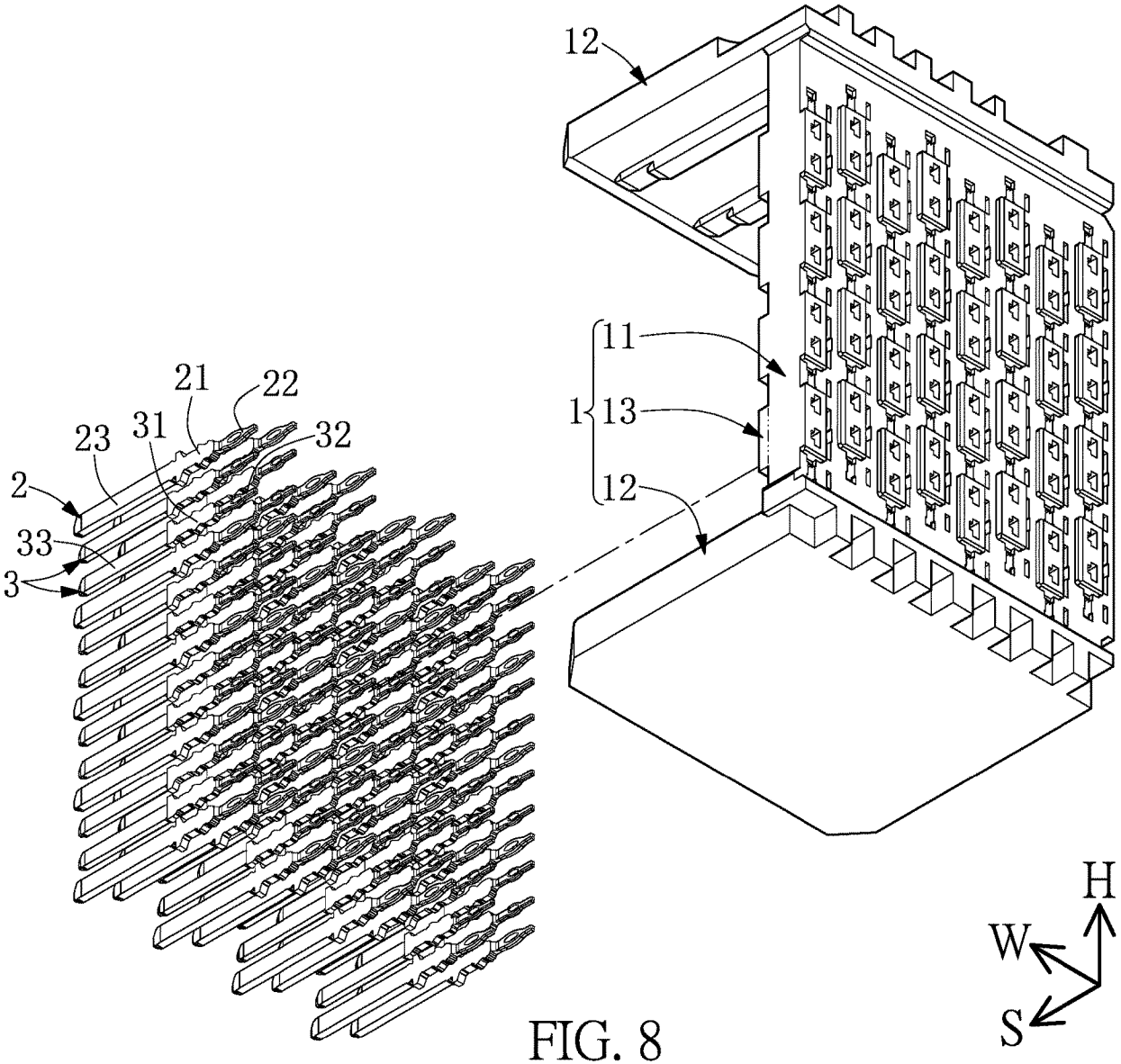
FIG. 8 is an exploded view showing an insulating body, ground terminals, and signal terminals of FIG. 2.

As shown in FIG. 7 and FIG. 8, the insulating body 1 in the present embodiment is integrally formed as a one-piece structure, and includes a base board 11, two side boards 12 respectively extending from two opposite ends of the base board 11 along the insertion direction S, and a plurality of protruding portions 13 extending from the base board 11 and arranged between the two side boards 12. The two side boards 12 in the present embodiment are substantially and perpendicularly connected to the base board 11, so that the insulating body 1 is a substantially U-shaped structure.

Specifically, the base board 11 includes a first tread 111 and a board surface 112 that is opposite to the first tread 111. The first tread 111 in the present embodiment is arranged on an inner side of the insulating body 1 (or an inner side of the U-shaped structure), and the board surface 112 is arranged on an outer side of the insulating body 1 (or an outer side of the U-shaped structure). In the present embodiment, the protruding portions 13 are arranged in a plurality of columns along the width direction W, and the protruding portions 13 belonging to any two of the columns adjacent to each other are arranged staggeredly and formed on the first tread 111 of the base board 11. Moreover, each of the protruding portions 13 includes a second tread 131 arranged away from the base board 11 and a riser 132 that is connected to and between the second tread 131 and the first tread 111.

The ground terminals 2 and the signal terminals 3 are inserted into the insulating body 1 along the insertion direction S by passing through a space between the two side boards 12. The ground terminals 2 are fastened to the base board 11, and the signal terminals 3 are fastened to the base board 11 and are respectively inserted into the protruding portions 13. In other words, each of the ground terminals 2 is inserted into the insulating body 1 by passing through the first tread 111, and each of the signal terminals 3 is inserted into the insulating body 1 by passing through the second tread 131 of the corresponding protruding portion 13, but the present disclosure is not limited thereto. For example, in other embodiments of the present disclosure, the ground terminals 2 and the signal terminals 3 can be inserted into the insulating body 1 from different sides of the base board 11; or, the ground terminals 2 and the signal terminals 3 can be fastened to the insulating body 1 by an insert molding manner.

Moreover, the ground terminals 2 and the signal terminals 3 in the present embodiment are jointly defined as (or are arranged to be) a plurality of terminal rows each parallel to the height direction H, and an arrangement direction of each of the terminal rows is substantially perpendicular to any one of the two side boards 12 (or perpendicular to the insertion direction S). In the present embodiment, the electrical connector 100 includes eight terminal rows. In any one of the terminal rows, two of the signal terminals 3 adjacent to each other (i.e., a differential signal pair) are provided with two of the ground terminals 2 respectively arranged at two opposite sides thereof, but the present disclosure is not limited thereto. For example, in other embodiments of the present disclosure, two differential signal pairs (i.e., the signal terminals 3) can be separated from each other by two of the ground terminals 2.

As the ground terminals 2 of the present embodiment are of substantially the same structure, the following description discloses the structure of just one of the ground terminals 2 for the sake of brevity, but the present disclosure is not limited thereto. In other words, in other embodiments of the present disclosure, the ground terminals 2 of the electrical connector 100 may be formed of different structures, or at least one of the ground terminals 2 of the electrical connector 100 may be formed in accordance with the following description.

Figure 9:
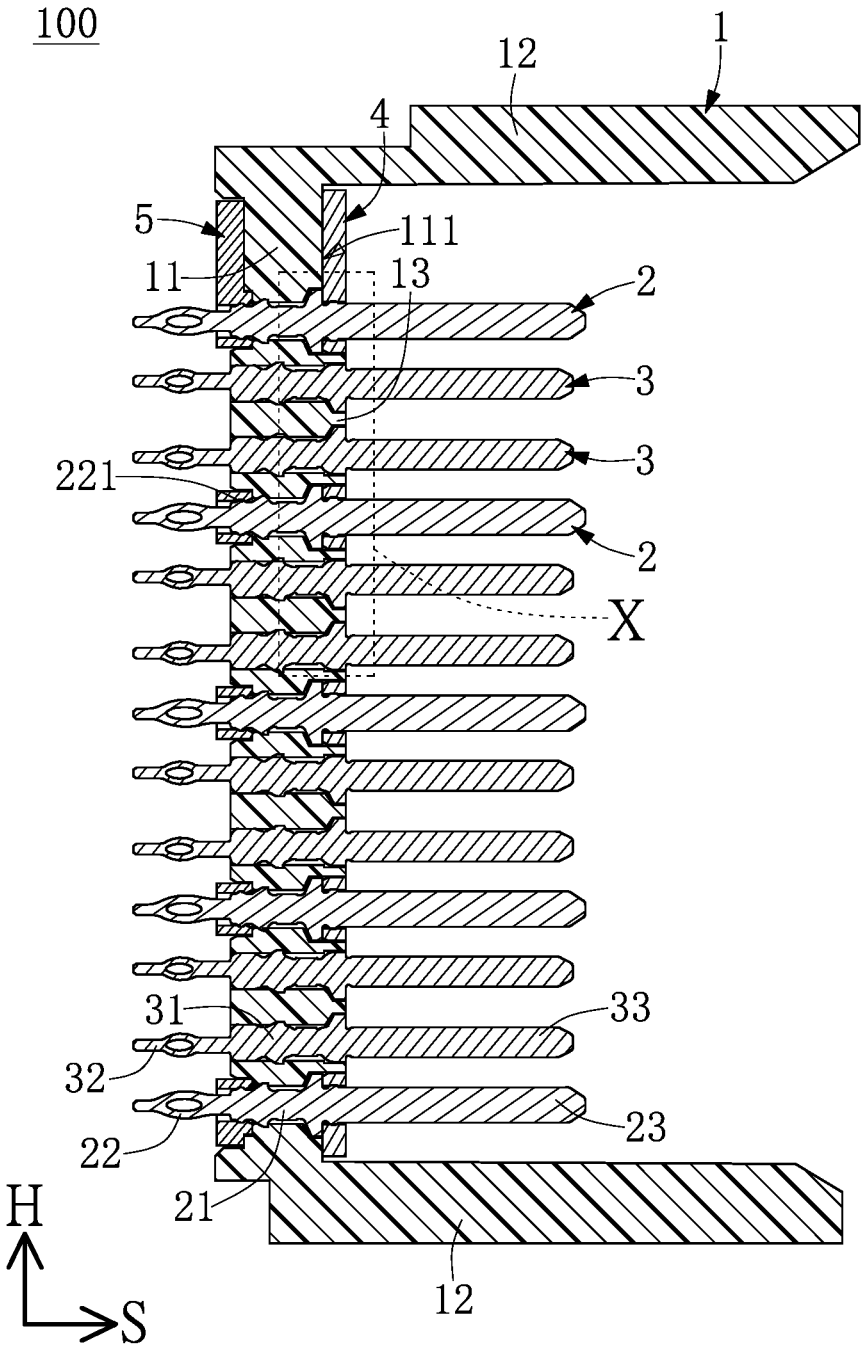
FIG. 9 is a cross-sectional view taken along line IX-IX of FIG. 3.
Figure 10:
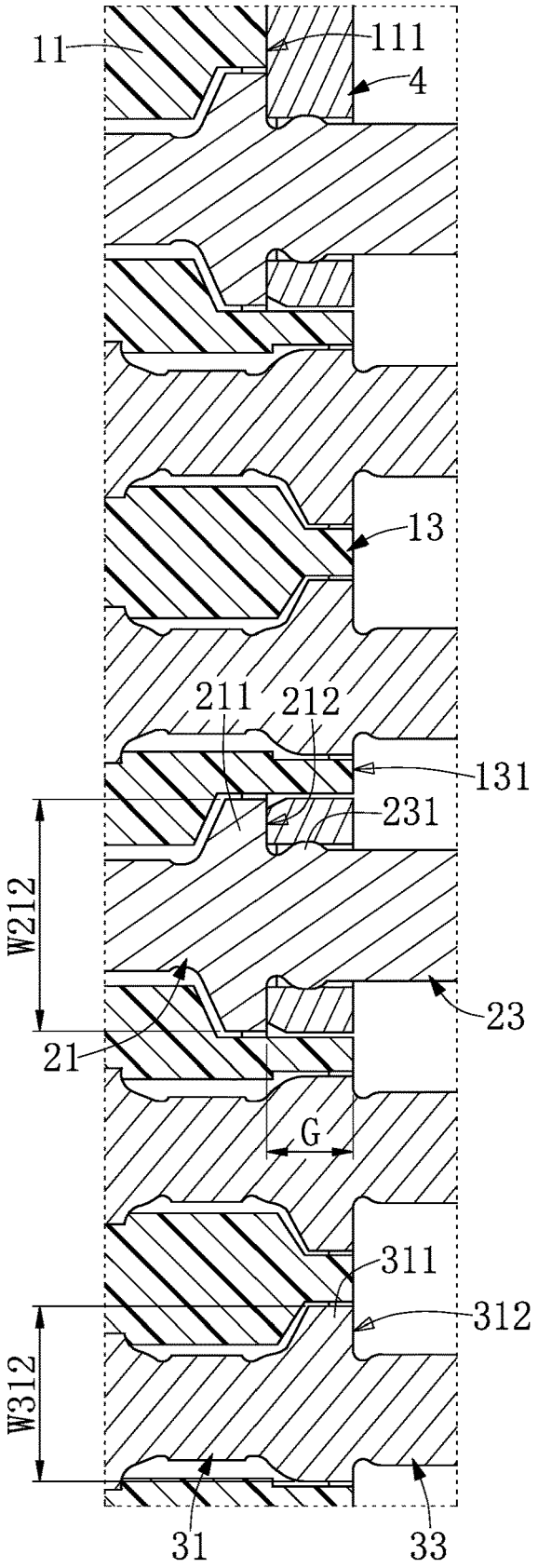
FIG. 10 is an enlarged view of portion X of FIG. 9.
Figure 11:
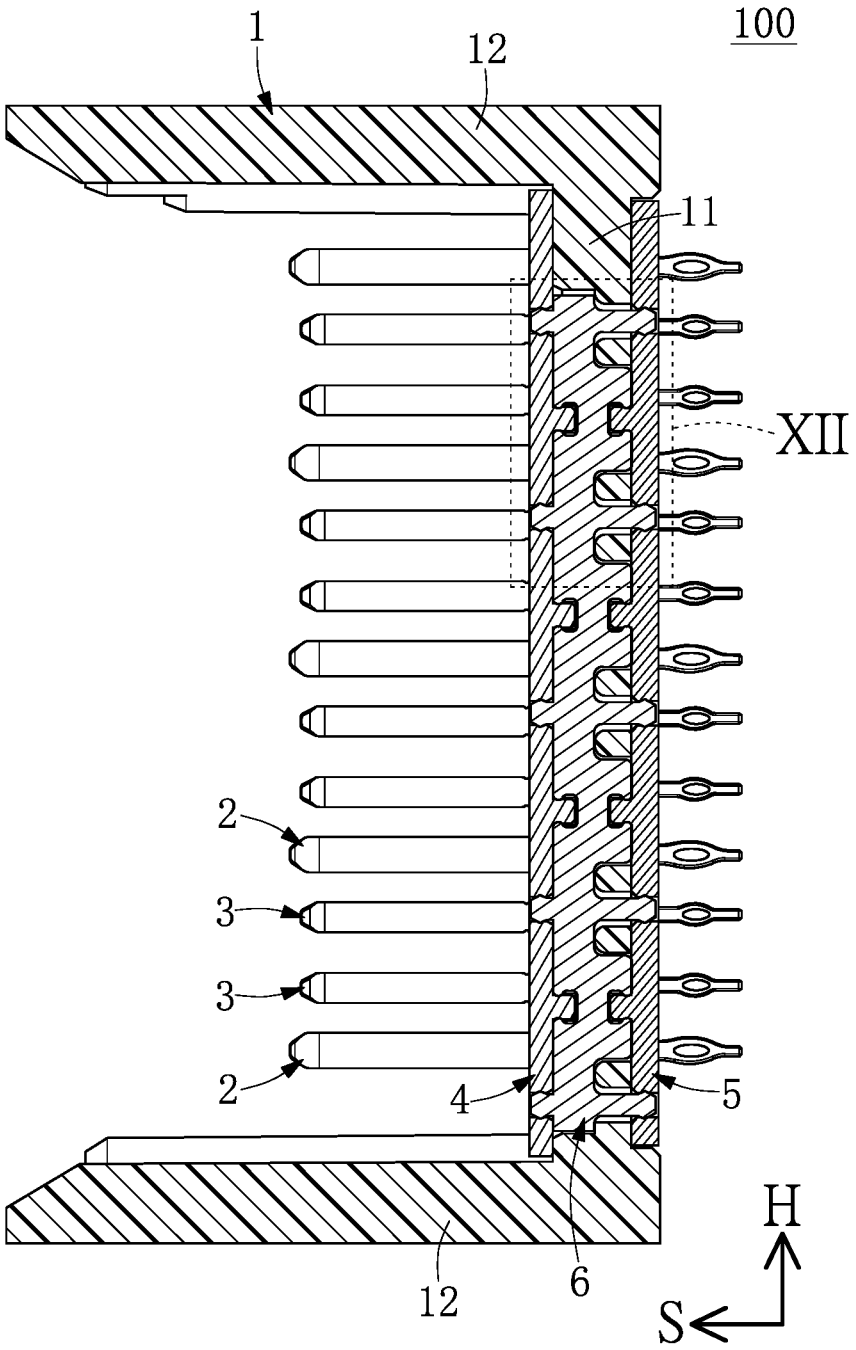
FIG. 11 is a cross-sectional view taken along line XI-XI of FIG. 3.
Figure 12:
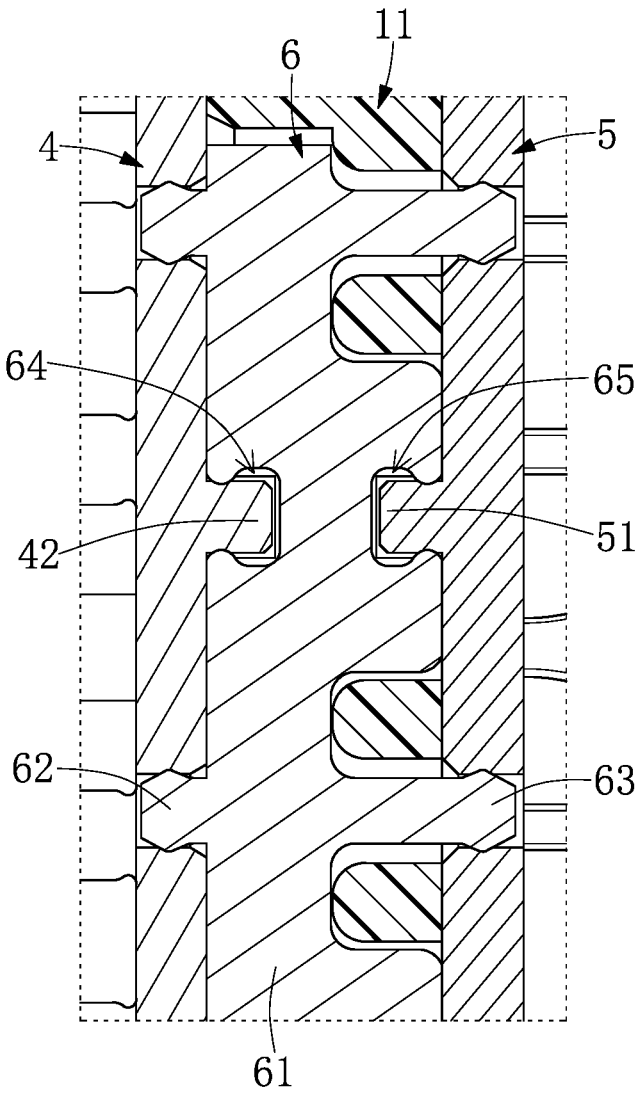
FIG. 12 is an enlarged view of portion XII of FIG. 11.

As shown in FIG. 9 and FIG. 10, the ground terminal 2 is an elongated structure parallel to the insertion direction S, and includes an embedded ground segment 21 disposed in the base board 11, a fixing ground segment 22 extending from an end of the embedded ground segment 21 along the insertion direction S to protrude from the insulating body 1 (or the base board 11), and a contacting ground segment 23 extending from another end of the embedded ground segment 21 along the insertion direction S to protrude from the insulating body 1 (or the base board 11).

The embedded ground segment 21 includes a ground shoulder 211 arranged adjacent to the first tread 111. A top edge 212 of the ground shoulder 211 (e.g., an edge of the ground shoulder 211 arranged away from the fixing ground segment 22) is coplanar with the first tread 111, the ground shoulder 211 in the present embodiment has a width W212 along the height direction H, and the width W212 of the ground shoulder 211 is a maximum width of the ground terminal 2.

Moreover, the fixing ground segment 22 protrudes from the board surface 112 of the insulating body 1, and the fixing ground segment 22 in the present embodiment is a fisheye-shaped tail, but the present disclosure is not limited thereto. In other embodiments of the present disclosure, the fixing ground segment 22 can be a structure suitable for being applied to surface-mount technology (SMT) or ball grid array (BGA). The contacting ground segment 23 protrudes from the first tread 111 of the insulating body 1, and a length of the contacting ground segment 23 along the insertion direction S is at least 50% of a length of the ground terminal 2.

As the signal terminals 3 of the present embodiment are of substantially the same structure, the following description discloses the structure of just one of the signal terminals 3 for the sake of brevity, but the present disclosure is not limited thereto. In other words, in other embodiments of the present disclosure, the signal terminals 3 of the electrical connector 100 may be formed of different structures, or at least one of the signal terminals 3 of the electrical connector 100 may be formed as in the following description.

The signal terminal 3 is an elongated structure parallel to the insertion direction S, and includes an embedded signal segment 31 disposed in the base board 11 and the corresponding protruding portion 13, a fixing signal segment 32 extending from an end of the embedded signal segment 31 along the insertion direction S to protrude from the insulating body 1 (or the base board 11), and a contacting signal segment 33 extending from another end of the embedded signal segment 31 along the insertion direction S to protrude from the insulating body 1 (or the base board 11).

The embedded signal segment 31 includes a signal shoulder 311 arranged adjacent to the corresponding second tread 131, in other words, the signal shoulder 311 is arranged adjacent to the second tread 131 of the corresponding protruding portion 13. A top edge 312 of the signal shoulder 311 (e.g., an edge of the signal shoulder 311 arranged away from the fixing signal segment 32) is coplanar with the corresponding second tread 131, the signal shoulder 311 in the present embodiment has a width W312 along the height direction H, and the width W312 of the signal shoulder 311 is a maximum width of the signal terminal 3.

Moreover, the fixing signal segment 32 protrudes from the board surface 112 of the insulating body 1, and the fixing signal segment 32 in the present embodiment is a fisheye-shaped tail, but the present disclosure is not limited thereto. In other embodiments of the present disclosure, the fixing signal segment 32 can be a structure suitable for being applied to surface-mount technology (SMT) or ball grid array (BGA). The contacting signal segment 33 protrudes from the corresponding second tread 131 of the insulating body 1, and a length of the contacting signal segment 33 along the insertion direction S is at least 50% of a length of the signal terminal 3.

In the ground terminal 2 and the signal terminal 3 both adjacent to each other, the top edge 212 of the ground shoulder 211 arranged adjacent to the first tread 111 and the top edge 312 of the signal shoulder 311 arranged adjacent to the corresponding second tread 131 have a gap G therebetween along the insertion direction S. Accordingly, the ground shoulder 211 formed on the ground terminal 2 and the signal shoulder 311 formed on the signal terminal 3 of the electrical connector 100 in the present embodiment are respectively arranged at different planes by having the gap G therebetween, so that the width W212 of the ground shoulder 211 and the width W312 of the signal shoulder 311 can be wider for effectively reducing the impedance and increasing the distribution density of terminals of the electrical connector 100, achieving the miniaturization of the electrical connector 100.

In addition, the protruding portions 13 and the corresponding structures of the terminals in the present embodiment are arranged between the two side boards 12, but the present disclosure is not limited thereto. For example, in other embodiments of the present disclosure, the protruding portions 13 and the corresponding structures of the terminals can be arranged outside of the two side boards 12 (e.g., the protruding portion 13, the ground shoulder 211, and the signal shoulder 311 are arranged adjacent to the board surface 112 of the base board 11).

As shown in FIG. 4, FIG. 6, FIG. 11, and FIG. 12, at least one of the first conductive member 4 and the second conductive member 5 can be an electro-plated plastic member or can be made of conductive resin according to design requirements, but the present disclosure is not limited thereto. For example, in other embodiments of the present disclosure, at least one of the first conductive member 4 and the second conductive member 5 can be a metal plate.

The first conductive member 4 in the present embodiment corresponds in shape to the first tread 111 of the base board 11; that is to say, the first conductive member 4 is substantially complementary to the protruding portions 13 of the insulating body 1. In other words, the first conductive member 4 has a plurality of thru-holes 41 respectively corresponding in position to the protruding portions 13.

Specifically, the first conductive member 4 is disposed on the first tread 111 of the base board 11, the protruding portions 13 of the insulating body 1 are respectively arranged in the thru-holes 41, and a surface of the first conductive member 4 arranged away from the base board 11 is coplanar with the second treads 131 of the protruding portions 13. The contacting ground segment 23 of each of the ground terminals 2 protrudes from and passes through the first conductive member 4, and the contacting ground segment 23 has an interference structure 231 arranged adjacent to the first tread 111 (As shown in FIG. 10), so that the contacting ground segment 23 can be engaged with and fixed to the first conductive member 4 through the interference structure 231. In other words, the first conductive member 4 is connected to the ground terminals 2, so that the ground terminals 2 can be commonly grounded by the first conductive member 4.

The shape of the second conductive member 5 is similar to that of the first conductive member 4, the second conductive member 5 is disposed on the board surface 112 of the base board 11, and the fixing ground segment 22 of each of the ground terminals 2 protrudes from and passes through the second conductive member 5. The fixing ground segment 22 has an interference structure 221 arranged adjacent to the board surface 112 (as shown in FIG. 9), so that the fixing ground segment 22 can be engaged with and fixed to the second conductive member 5 through the interference structure 221. In other words, the second conductive member 5 is connected to the ground terminals 2, so that the ground terminals 2 can be commonly grounded by the second conductive member 5.

The grounding members 6 are fastened to the base board 11. The grounding members 6 in the present embodiment are inserted into and engaged in the base board 11 along the insertion direction S, and at least one of the grounding members 6 is arranged between any two of the terminal rows adjacent to each other and is parallel to the arrangement direction of the terminal row. Any one of the grounding members 6 is perpendicularly connected to the first conductive member 4 and the second conductive member 5, and the ground terminals 2, the first conductive member 4, the second conductive member 5, and the grounding members 6 of the electrical connector 100 can be electrically coupled to each other so as to form a grounded grid, thereby achieving a common ground effect.

Moreover, the grounding members 6 in the present embodiment can be connected to the first conductive member 4 and the second conductive member 5 by the following structure, but the present disclosure is not limited thereto. In other words, the connection manner of the grounding members 6 with respect to the first conductive member 4 and the second conductive member 5 can be adjusted or changed according to design requirements.

As the grounding members 6 of the present embodiment are of substantially the same structure, the following description discloses the structure of just one of the grounding members 6 for the sake of brevity, but the present disclosure is not limited thereto. In other words, in other embodiments of the present disclosure, the grounding member 6 of the electrical connector 100 may be formed of different structures, or the number of the grounding members 6 in the electrical connector 100 can be at least one.

Specifically, the grounding member 6 is an elongated structure parallel to the height direction H, and includes a beam 61 disposed in the base board 11, a plurality of first conductive portions 62 extending from the beam 61 to protrude from the first tread 111, and a plurality of second conductive portions 63 extending from the beam 61 to protrude from the board surface 112. The grounding member 6 includes a plurality of first clamping slots 64 arranged in the base board 11 and a plurality of second clamping slots 65 arranged in the base board 11. In the present embodiment, the first clamping slots 64 and the second clamping slots 65 are respectively recessed in two opposite long edges of the beam 61, but the present disclosure is not limited thereto.

Moreover, a height of any one of the first conductive portions 62 of the grounding member 6 along the insertion direction S is less than or equal to a thickness of the first conductive member 4, and the first conductive portions 62 of the grounding member 6 are engaged in the first conductive member 4. A height of any one of the second conductive portion 63 of the grounding member 6 along the insertion direction S is less than or equal to a thickness of the second conductive member 5, and the second conductive portions 63 of the grounding member 6 are engaged in the second conductive member 5.

Accordingly, the grounding member 6 can be electrically connected to the first conductive member 4 and the second conductive member 5. In addition, the first conductive portion 62 and the second conductive portion 63 protruding from the base board 11 can be used for assembling and positioning the first conductive member 4 and the second conductive member 5 to the base board 11.

Moreover, the first conductive member 4 includes a plurality of first protrusions 42 arranged in the base board 11, and the second conductive member 5 includes a plurality of second protrusions 51 arranged in the base board 11. In other words, the first protrusions 42 mutually face the second protrusions 51, and the first protrusions 42 and the second protrusion 51 extend toward each other along the insertion direction S so as to be arranged in the base board 11. Moreover, the first protrusions 42 and the second protrusions 51 correspond in position to the grounding member 6. Specifically, the first protrusions 42 and the second protrusions 51 further respectively face and correspond in position to each other (shown as FIG. 12).

Specifically, the first protrusions 42 of the first conductive member 4 are respectively engaged in the first clamping slots 64 of the grounding members 6, and the second protrusions 51 of the second conductive member 5 are respectively engaged in the second clamping slots 65 of the grounding members 6. In other words, each of the first protrusions 42 is clamped by one of the first clamping slots 64, and each of the second protrusions 51 is clamped by one of the second clamping slots 65, so that the first conductive member 4 and the second conductive member 5 are respectively and firmly fixed to two opposite long edges of each of the grounding members 6.

In conclusion, the ground terminal and the signal terminal of the electrical connector in the present disclosure can be formed with the ground shoulder and the signal shoulder, and the ground shoulder and the signal shoulder are respectively arranged at different planes by having the gap therebetween, so that the width of the ground shoulder and the width of the signal shoulder can be wider for effectively reducing the impedance and increasing the distribution density of terminals of the electrical connector, thus achieving the miniaturization of the electrical connector.

Specifically, the ground terminal and the signal terminal of the electrical connector in the present disclosure are provided in cooperation with the insulating body in accordance with the ground shoulder and the signal shoulder (e.g., the top edge of the ground shoulder is coplanar with the first tread of the base board, and the top edge of the signal shoulder is coplanar with the second tread of the corresponding protruding portion), so that the ground shoulder and the signal shoulder can be used to abut against or support a pressing mold, effectively increasing the reliability that is related about mounting the electrical connector onto a circuit board.

Moreover, the electrical connector of the present disclosure is provided with the first conductive member, the second conductive member, and at least one grounding member that is connected to and between the first conductive member and the second conductive member, and the ground terminals, the first conductive member, the second conductive member, and the grounding members of the electrical connector can be electrically coupled to each other so as to form a grounded grid, thereby achieving a common ground effect.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector, comprising:

an insulating body including a base board and a plurality of protruding portions extending from the base board, wherein the base board has a first tread, and each of the protruding portions has a second tread and a riser that is connected to the second tread and the first tread;

a plurality of ground terminals fastened to the base board, wherein at least one of the ground terminals includes:

an embedded ground segment disposed in the base board and having a ground shoulder arranged adjacent to the first tread;

a fixing ground segment extending from an end of the embedded ground segment along an insertion direction to protrude from the insulating body; and a contacting ground segment extending from another end of the embedded ground segment along the insertion direction to protrude from the insulating body; and a plurality of signal terminals fastened to the base board and respectively inserted into the protruding portions, wherein at least one of the signal terminals includes:

an embedded signal segment disposed in the base board and the corresponding protruding portion and having a signal shoulder arranged adjacent to the second tread of the corresponding protruding portion;

a fixing signal segment extending from an end of the embedded signal segment along the insertion direction to protrude from the insulating body; and a contacting signal segment extending from another end of the embedded signal segment along the insertion direction to protrude from the insulating body;

wherein in the at least one of the ground terminals having the ground shoulder and the at least one of the signal terminals having the signal shoulder, a top edge of the ground shoulder arranged adjacent to the first tread and a top edge of the signal shoulder arranged adjacent to the corresponding second tread have a gap therebetween along the insertion direction.

2. The electrical connector according to claim 1, wherein in the at least one of the ground terminals having the ground shoulder and the at least one of the signal terminals having the signal shoulder, the top edge of the ground shoulder is coplanar with the first tread, the top edge of the signal shoulder is coplanar with the corresponding second tread, a width of the ground shoulder is a maximum width of the ground terminal, and a width of the signal shoulder is a maximum width of the signal terminal.

3. The electrical connector according to claim 1, further comprising a first conductive member disposed on the first tread, wherein the first conductive member has a plurality of thru-holes, wherein the protruding portions of the insulating body are respectively arranged in the thru-holes, and wherein in the at least one of the ground terminals having the ground shoulder, the contacting ground segment passes through the first conductive member.

4. The electrical connector according to claim 3, wherein a surface of the first conductive member arranged away from the base board is coplanar with the second treads of the protruding portions.

5. The electrical connector according to claim 3, further comprising a second conductive member disposed on a board surface of the base board that is opposite to the first tread, wherein in the at least one of the ground terminals having the ground shoulder, the fixing ground segment passes through the second conductive member.

6. The electrical connector according to claim 5, further comprising at least one grounding member fastened to the base board, wherein the at least one grounding member is connected to the first conductive member and the second conductive member.

7. The electrical connector according to claim 6, wherein the ground terminals and the signal terminals are jointly defined as a plurality of terminal rows, wherein in any one of the terminal rows, two of the signal terminals adjacent to each other are provided with two of the ground terminals respectively arranged at two opposite sides thereof, and wherein the at least one grounding member is arranged between any two of the terminal rows adjacent to each other.

8. The electrical connector according to claim 7, wherein the at least one grounding member is parallel to an arrangement direction of any one of the terminal rows.

9. The electrical connector according to claim 6, wherein the at least one grounding member includes a beam disposed in the base board, a plurality of first conductive portions extending from the beam to protrude from the first tread, and a plurality of second conductive portions extending from the beam to protrude from the board surface, and wherein the first conductive portions of the at least one grounding member are engaged in the first conductive member, and the second conductive portions of the at least one grounding member are engaged in the second conductive member.

10. The electrical connector according to claim 9, wherein a height of any one of the first conductive portions of the grounding member along the insertion direction is less than or equal to a thickness of the first conductive member.

11. The electrical connector according to claim 9, wherein a height of any one of the second conductive portions of the grounding member along the insertion direction is less than or equal to a thickness of the second conductive member.

12. The electrical connector according to claim 6, wherein the at least one grounding member includes a plurality of first clamping slots arranged in the base board and a plurality of second clamping slots arranged in the base board, wherein the first conductive member includes a plurality of first protrusions arranged in the base board and respectively engaged in the first clamping slots of the at least one grounding member, and wherein the second conductive member includes a plurality of second protrusions arranged in the base board and respectively engaged in the second clamping slots of the at least one grounding member.

13. The electrical connector according to claim 3, wherein the first conductive member corresponds in shape to the first tread of the base board, and the first conductive member is substantially complementary to the protruding portions of the insulating body.

14. The electrical connector according to claim 3, wherein the contacting ground segment has an interference structure arranged adjacent to the first tread, and the contacting ground segment is engaged with and fixed to the first conductive member through the interference structure.

15. The electrical connector according to claim 5, wherein the fixing ground segment has an interference structure arranged adjacent to the board surface, and the fixing ground segment is engaged with and fixed to the second conductive member through the interference structure.

16. The electrical connector according to claim 5, wherein at least one of the first conductive member and the second conductive member is an electro-plated plastic member or is made of conductive resin.

17. The electrical connector according to claim 1, wherein the insulating body includes two side boards respectively extending from two opposite ends of the base board along the insertion direction, and the protruding portions are arranged between the two side boards.

18. The electrical connector according to claim 17, wherein the ground terminals and the signal terminals are inserted into the insulating body along the insertion direction by passing through a space between the two side boards.

* * * * *